United States Patent [19]

Dupuy

[11] Patent Number: 4,713,905

[45] Date of Patent: Dec. 22, 1987

[54] ATTACHMENT FOR A FIREARM

[76] Inventor: Timothy C. Dupuy, 12416 S. Harrells Ferry Rd., Bldg. 4-D Baton Rouge, La. 70816

[21] Appl. No.: 942,738

[22] Filed: Dec. 17, 1986

[51] Int. Cl.[4] ..... F41C 23/02

[52] U.S. Cl. ..... 42/85

[58] Field of Search ..... 48/85, 71.01, 74, 72

[56] References Cited

U.S. PATENT DOCUMENTS

| | | | |
|---|---|---|---|
| 1,088,314 | 2/1914 | Wilcke | 42/85 |
| 2,350,484 | 6/1944 | Williams | 42/85 |
| 2,696,059 | 12/1954 | Judd | 42/85 |
| 2,885,812 | 5/1959 | Arpin | 42/85 |
| 3,665,632 | 5/1972 | Ford | 42/85 |

*Primary Examiner*—Charles T. Jordan

*Attorney, Agent, or Firm*—Sughrue, Mion, Zinn, Macpeak & Seas

[57] ABSTRACT

An attachment for a firearm having a stock and butt plate comprising a plate member attached between the stock and butt plate, said plate being dimensioned equally as the stock and butt plate whereby the edges of the plate lie flush with the edges of the stock and butt plate, and the plate has a sleeve extending forwardly and downwardly away from a bottom edge thereof, for a receiving a swivel on the rear end of a firearm sling whose front end is attached to the front end of the firearm.

7 Claims, 3 Drawing Figures

ATTACHMENT FOR A FIREARM

BACKGROUND OF THE INVENTION

1. Field of the Invention

This invention relates to an attachment for a firearm for attaching a sling thereto.

2. Background of the Prior Art

The prior art shows gunsling supporting devices having hardware for permitting attachment of the gunsling to the base of the firearm. Representative of the prior art are the following patents.

| Inventor | Patent No. | Title |
|---|---|---|
| Wade L. Ford | 3,665,632 | Firearm Shoulder Support and Strap |
| Leon G. Arpin | 2,885,812 | Gun Supporting Sling |
| D. M. Williams | 2,350,484 | Firearm with Sling-Strap |
| A. Wilcke | 1,088,314 | Gunsling Attaching Means |

SUMMARY OF THE INVENTION

There is a need for a simple yet durable device to permit easy attachment of a gunsling to the base of a firearm. The device is easily attached to the base of a firearm without penetrating or defacing the stock of the firearm.

It is therefor an object of this invention to provide a sling support device interposed between the butt plate and stock of a firearm which does not affect the operation of the firearm while the device is attached and in use.

It is another object of this invention to provide said sling support device in a dimension, shape and position which permits it to lie flat against the end of the stock, and flush with the sides thereof, and with the butt plate and does not change the configuration of the stock.

It is another object of this invention to provide said sling support device with an integral sleeve for receiving the swivel hardware of a gunsling.

These and other objects of the invention will become apparent to those skilled in the art to which the invention pertains from a reading of the following specifications when taken in light of the annexed drawings.

DESCRIPTION OF THE PREFERRED EMBODIMENT OF THE INVENTION

Figure 1:
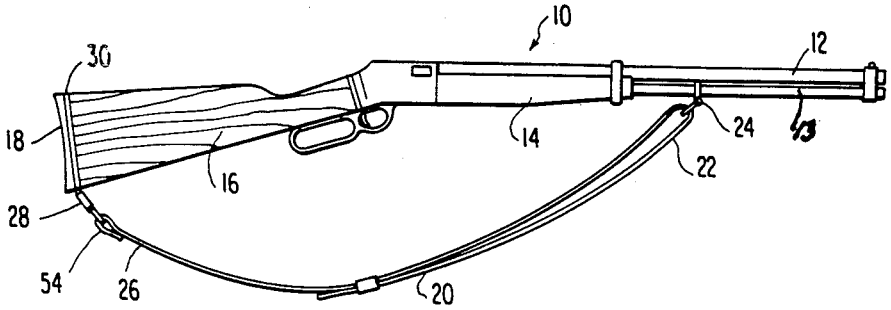
FIG. 1 is a perspective view of a firearm with the sling attached thereto.
Figure 2:
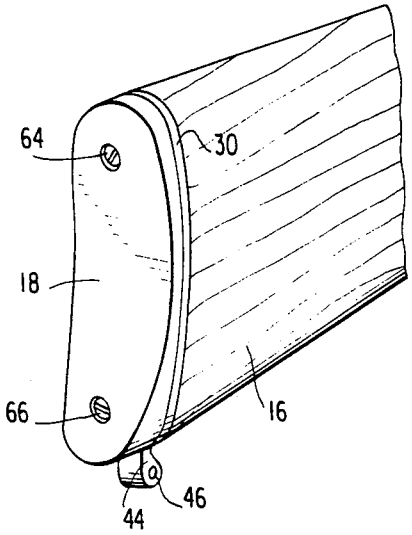
FIG. 2 is a perspective view of the stock, butt plate and sling-supporting attachment of the invention.
Figure 3:
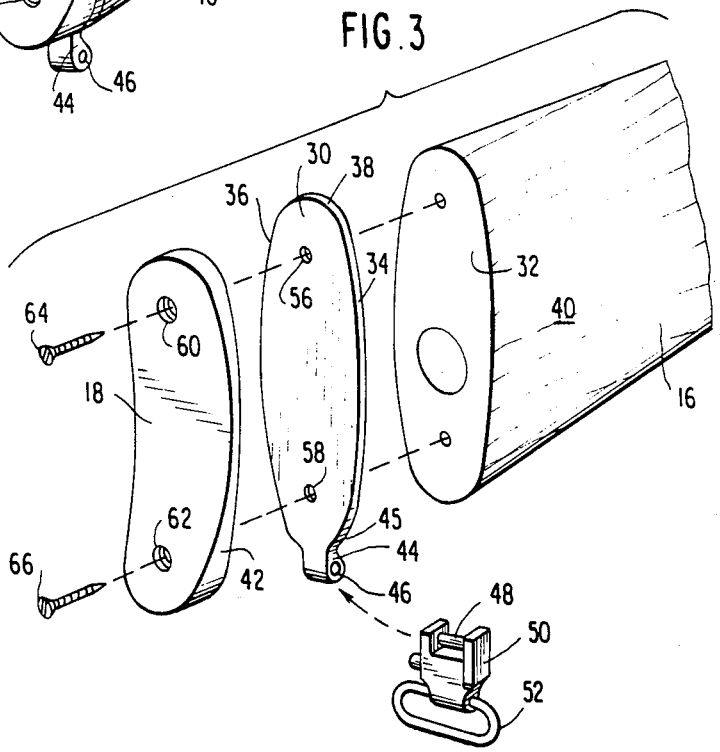
FIG. 3 is an exploded view of the stock, butt plate and sling-supporting device with typical sling swivel attachment illustrated adjacent thereto.

Referring now in more detail to the drawings, FIG. 1 shows a firearm 10 having a barrel 12, magazine 13, forestock 14, stock 16, butt plate 18 and sling 20. The sling 20 is attached at its forward end 22 to the forward end 12, 13 or 14 of the firearm 10 by hardware 24 and at its rearward end 26 to the stock 16 by a swivel 28 and plate 30. Referring now to FIG. 3, plate 30 can be of any durable material such as plastic, hard rubber or metal and is dimensioned to lie flat against the end 32 of the butt 16. The outside edges 34 and 36 and topside 38 lie flush with the outside surface 40 of the stock 16 and the outside surface 42 of the butt plate 18. Integral with the plate 30 is a sleeve 44 extending forwardly and downwardly away from bottom side 45. The sleeve 44 has a bore 46 for receiving the pin 48 of the swivel 50. Swivel 50 has a ring 52 for receiving the loop 54 of sling 20. Plate 30 has apertures 56 and 58 corresponding to aperture 60 and 62 in butt plate 18. Screws 64 and 66 fasten the butt plate 18 and plate 30 to the stock 16.

The plate 30 eliminates the necessity for drilling holes in the stock of a firearm to attach a sling. The plate retains the natural appearance of a firearm by providing a means of attaching a sling without penetrating or defacing or making any alteration to the stock. Further, the sleeve 44 is round and cylindrical, thus eliminating sharp edges which could cause damage or injury to the firearm user.

While the invention has been described with regard to a preferred embodiment thereof, it will be appreciated by those skilled in the art to which the invention pertains that novel changes may be made in the attachment without departing from the spirit and scope thereof.

What is claimed is:

1. A rear sling attachment for a firearm having a longitudinally extending stock and a butt plate at the rear end of the stock, said attachment comprising a plate member attached between the stock and butt plate and extending vertically between top and bottom edges of the stock, said plate being dimensioned equally as the end of the stock and butt plate whereby the edges of said plate lie flush with the edges of said stock and butt plate, and said plate having sleeve means extending downwardly and forwardly from the bottom edge thereof for receiving a swivel on the rear end of a firearm sling whose front end is attached to the front end of the firearm.

2. An attachment for a firearm having a stock and butt plate according to claim 1, wherein:

said plate is of any durable material and said sleeve means is integral therewith.

3. An attachment for a firearm having a stock and butt plate according to claim 1, wherein:

said sleeve means has a horizontal bore for receiving a pin of the swivel, whereby said swivel is removably attached to said sleeve means.

4. An attachment for a firearm having a stock and butt plate according to claim 1, and:

said sleeve means being round and cylindrical.

5. An attachment for a firearm having a stock and butt plate according to claim 2, wherein:

said durable material is metal.

6. An attachment for a firearm having a stock and butt plate according to claim 2, wherein:

said durable material is plastic.

7. An attachment for a firearm according to claim 1, wherein said rear sling attachment replaces a conventional sling attachment screwed into the rear of the stock, and wherein the only two sling attachments on the firearm are said rear sling attachment and a front sling attachment for attaching the front end of the sling to the front end of the firearm.

* * * * *